US005766038A

United States Patent [19]

Sugie

[11] Patent Number: 5,766,038

[45] Date of Patent: Jun. 16, 1998

[54] WATERPROOF CONNECTOR

[75] Inventor: Naoto Sugie, Haibara-gun, Japan

[73] Assignee: Yazaki Corporation, Tokyo, Japan

[21] Appl. No.: 746,546

[22] Filed: Nov. 13, 1996

[30] Foreign Application Priority Data

Nov. 15, 1995 [JP] Japan ..... 7-296537

[51] Int. Cl.[6] ..... H01R 13/40

[52] U.S. Cl. ..... 439/587

[58] Field of Search ..... 439/587, 589, 439/274, 275, 279

[56] References Cited

U.S. PATENT DOCUMENTS 5,538,441 7/1996 Paolucci et al. ..... 439/587

5,613,868 3/1997 Ohsumi et al. ..... 439/587

FOREIGN PATENT DOCUMENTS 5-77871 10/1993 Japan .

*Primary Examiner*—Gary F. Paumen

*Assistant Examiner*—T. C. Patel

*Attorney, Agent, or Firm*—Armstrong, Westerman, Hattori, McLeland & Naughton

[57] ABSTRACT

Waterproof connector in which the inner wall of a waterproof rubber packing is prevented from being damaged and waterproof function is not deteriorated. The waterproof connector comprises: a terminal accommodating chamber; and a waterproof rubber packing mounted on a terminal insertion side of the terminal accommodating chamber, wherein a side wall of the terminal accommodating chamber on the terminal insertion side has notches to form a resilient wall.

4 Claims, 4 Drawing Sheets

1

WATERPROOF CONNECTOR

BACKGROUND OF THE INVENTION

1. Field of the Invention

The present invention relates to a waterproof connector for use in an electrical circuit.

2. Description of the Related Art

A conventional connector for use in an electrical circuit is provided with a waterproof rubber packing on a terminal insertion side of a terminal accommodating chamber to prevent intrusion of water or the like. FIG. 5 is an exploded perspective view of one of such waterproof connectors. In FIG. 5, the waterproof connector 1 comprises a connector housing 5, a cover 3, and waterproof rubber packing 4. After inserted into the waterproof connector 1 assembled with the waterproof rubber packing 4 and the cover 3 through through-holes 3*b* and 4*a* of the cover 3 and the waterproof rubber packing 4 respectively, a terminal 2 (including a tip 2*a*, a tip metal 2*b*, and a wire portion 2*c*) further advances in a terminal accommodating chamber 5*d* in the connector housing 5 and is locked therein.

FIG. 6 is a cross-sectional view of the connector housing 5 taken along the line I—I of FIG. 5. The connector housing 5 is made from synthetic resin, and on the terminal insertion side, that is, at right of the figure, is formed a waterproof rubber packing accommodating portion 5*b* which is surrounded by an outer peripheral wall 5*c*. Behind the waterproof packing accommodating portion 5*b* are formed a plurality of terminal accommodating chambers 5*d*. In this conventional connector housing 5, the terminal accommodating chambers 5*d* are vertically juxtaposed, and each of the terminal accommodating chamber 5*d* is provided with a resilient locking arm 5*e* extending from the upper wall thereof. The resilient locking arm 5*e* locks the terminal 2 which is inserted from right side of the connector housing 5. The connector housing 5 further comprises an outer surface 5*a* and a locking arm 5*f* integral with the outer surface 5*a* to mate the connector housing 5 with the other connector not shown.

As illustrated in FIG. 5, the waterproof rubber packing 4 is formed to be a substantial rectangular, and corners thereof are rounded so as to be inserted into the waterproof packing accommodating portion 5*b* of the connector housing 5 and is secured thereto. The waterproof rubber packing 4 is provided with a plurality of through-holes 4*a* at positions corresponding to the terminal accommodating chambers 5*d* of the connector housing 5 through which the terminal 2 passes. The waterproof rubber packing 4 is mounted to prevent the intrusion of water or the like into the terminal accommodating chamber 5*d* from outside, so that two sealing portions 4*c* are formed around the side surface 4*b* of the waterproof rubber packing 4 and the sealing portions 4*c* closely contact with the inner wall of the outer peripheral wall 5*c* when the waterproof rubber packing 4 is inserted into the terminal accommodating chamber 5*d*. The diameter of the through-holes 4*a* is slightly smaller than the outer diameter of the wire portion 2*c*, and when the terminal 2 is accommodated in the terminal accommodating chamber 5*d* the inner wall of the through-holes 4*a* closely contact with the outer surface of the wire portion 2*c*.

The cover 3 is also made of synthetic resin, like the connector housing 5, and covers the waterproof rubber packing 4 which is inserted into the waterproof packing accommodating portion 5*b*. The cover 3 becomes integral with the connector housing 5 through the locking piece 3*a* and has a function of fixing the waterproof rubber packing 4 to the connector housing 5. The cover 3 is provided with a plurality of through-holes 3*b* at portions corresponding to the terminal accommodating chambers 5*d*, like the waterproof rubber packing 4, though which the terminal 2 passes.

At the use of the waterproof connector 1 with the above-mentioned construction, at first, the waterproof rubber packing 4 is inserted into the waterproof packing accommodating portion 5*b* of the connector housing 5, and the cover 3 is fixed to the connector housing 5 while covering the waterproof rubber packing 4, and at the same time, the waterproof rubber packing 4 is also secured to the connector housing 5 to assemble the waterproof connector 1. Then, the terminal 2 is inserted into the waterproof connector 1 through the through-holes 3*b* the cover 3 and the through-holes 4*a* of the waterproof rubber packing 4, and finally the terminal 2 passes through the terminal accommodating chamber 5*d* of the connector housing 5 so as to be locked in the connector housing 5 with the resilient locking arm 5*e*. As a result, behind the terminal 2 accommodated in the terminal accommodating chamber 5*d* is positioned the waterproof rubber packing 4, which prevents the intrusion of the water or the like into the terminal accommodating chamber 5*d* from outside.

SUMMARY OF THE INVENTION

In the conventional waterproof connector with the above construction, however, there is a problem at the insertion of the terminal 2 into the terminal accommodating chamber 5*d*. As illustrated in FIG. 7 which is a cross-sectional view of the waterproof connector 1 taken along the line II—II of FIG. 6, which shows the condition immediately before the tip 2*a* of the terminal 2 is inserted into the terminal accommodating chamber 5*d*, when the tip 2*a* of the terminal 2 passes through the inner wall 4*b* of the through-holes 4*a* of the waterproof rubber packing 4, a part of the inner wall 4*b* is shifted leftward in FIG. 7, and a part 4*c* of the inner wall 4*b* is nipped between the tip 2*a* and the front face 5*g* of the terminal accommodating chamber 5*d*, which damages the inner wall 4*b* of the waterproof rubber packing 4, resulting in poor sealing performance.

The present invention has been made in consideration of the problem of the conventional waterproof connector, and it is therefore the object of the present invention to provide a waterproof connector in which the inner wall of the waterproof rubber packing is prevented from being damaged and the waterproof function is not deteriorated.

The waterproof connector according to the present invention comprises: a terminal accommodating chamber; and a waterproof rubber packing mounted on a terminal insertion side of the terminal accommodating chamber, wherein a side wall of the terminal accommodating chamber on the terminal insertion side has notches to form a resilient wall.

In this waterproof connector, the side wall on the terminal insertion side may divide neighboring terminal accommodating chambers.

The above-mentioned waterproof connectors may have a plurality of terminal accommodating chambers which are vertically closely juxtaposed to each other.

BRIEF DESCRIPTION OF THE DRAWINGS

The present invention will be more apparent from the ensuring description with reference to the accompanying drawings wherein.

DETAILED DESCRIPTION OF PREFERRED EMBODIMENTS

Figure 1:
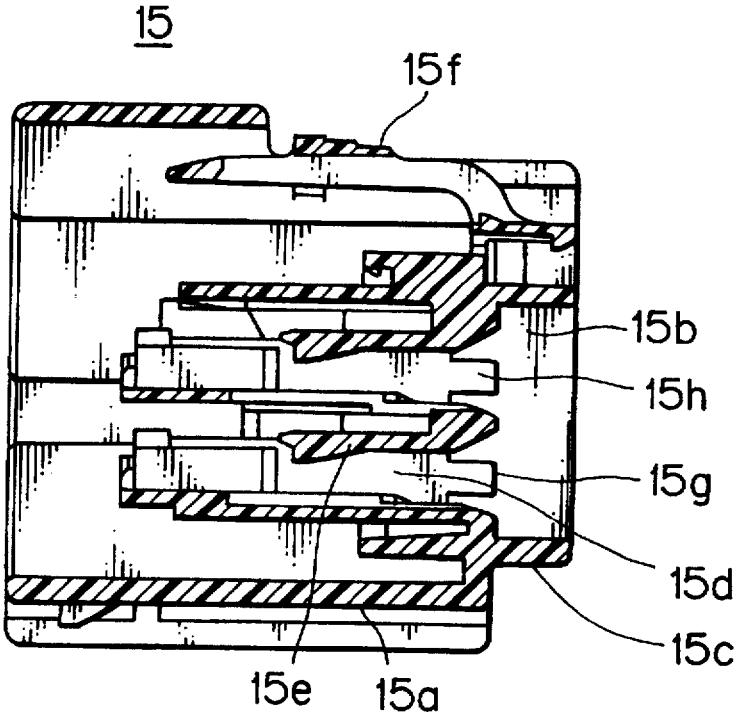
FIG. 1 is a cross-sectional view of a waterproof connector housing according to the present invention.

Now, a waterproof connector according to an embodiment of the present invention will be explained with reference to drawings.

Basic construction of the waterproof connector 10 (see FIGS. 3 and 4) according to the present invention is the same as the conventional waterproof connector 1 (illustrated in FIG. 5,) therefore, detailed explanation thereof will be omitted. In the waterproof connector according to the present invention also, the terminal 2 is inserted into the terminal accommodating chamber 15*d* (see FIG. 1) in the connector housing 15 of the waterproof connector 1 and is locked therein through the cover 3, waterproof rubber packing 4 of the waterproof connector 1.

The waterproof connector according to the preset invention is characterized of a connector housing 15 illustrated in FIG. 1. FIG. 1 is a cross-sectional view of the connector housing 15 corresponding to that of the connector housing 5 shown in FIG. 6 as a conventional one. The connector housing 15 is made of synthetic resin like the conventional one, and on the terminal insertion side of the connector housing 15, that is, at right portion thereof is formed a waterproof rubber packing accommodating portion 15*b* surrounded by the outer peripheral wall 15*c* like the conventional one, and behind the waterproof rubber packing accommodating portion 15*b* are formed a plurality of terminal accommodating chambers 15*d*.

In this embodiment also, the terminal accommodating chambers 15*d* are vertically juxtaposed, and each of the terminal accommodating chamber 15*d* is provided with a resilient locking arm 15*e* extending from the upper wall thereof to lock the terminal 2 inserted. The connector housing 15 further comprises the outer surface 15*a*, a locking arm 15*f* integral with the outer surface 15*a* to mate the connector housing 15 with the other connector not shown.

The connector housing 15 according to the present invention is characterized of the side walls 15*h*.

Figure 8:
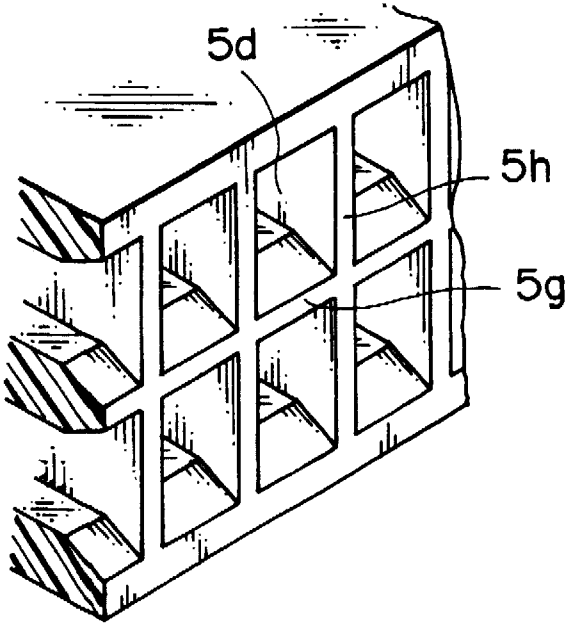
FIG. 8 PRIOR ART
FIG. 8 is a perspective view of side surfaces of terminal accommodating chambers of the conventional connector housing.
Figure 6:
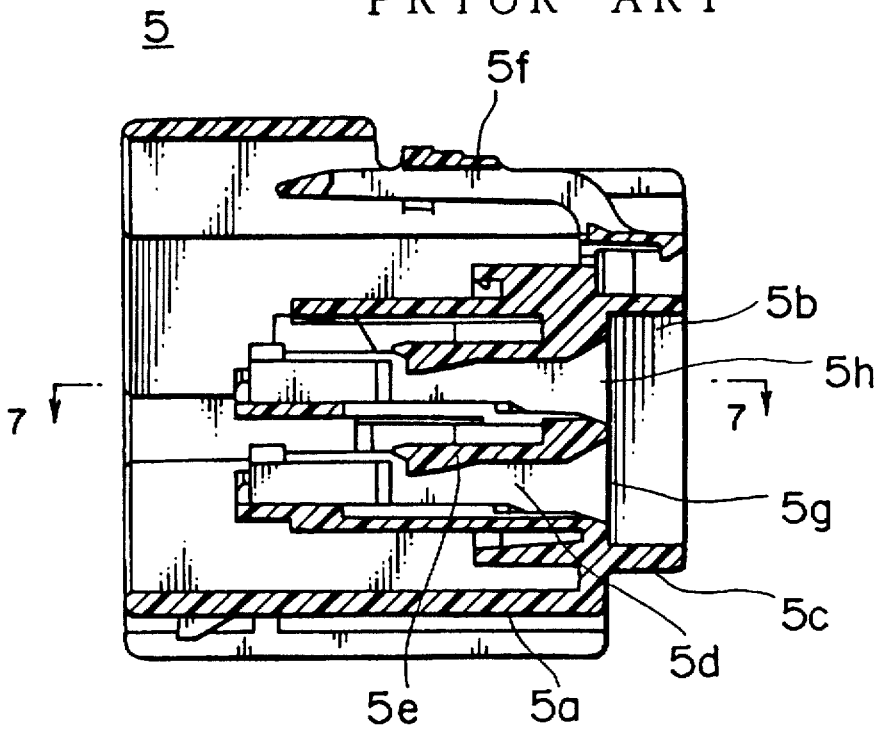
FIG. 6 PRIOR ART
FIG. 6 is a cross-sectional view of a connector housing of the waterproof connector shown in FIG. 5.

As illustrated in FIG. 6, the side walls 5*h* of the conventional connector housing 5 are successively formed with the upper and lower walls, and as illustrated in FIG. 8, when observed from terminal insertion side, the side walls 5*h* constitutes the box-shaped terminal accommodating chamber 15*d* and functions as partitions of the terminal accommodating chambers 15*d* as well.

Figure 2:
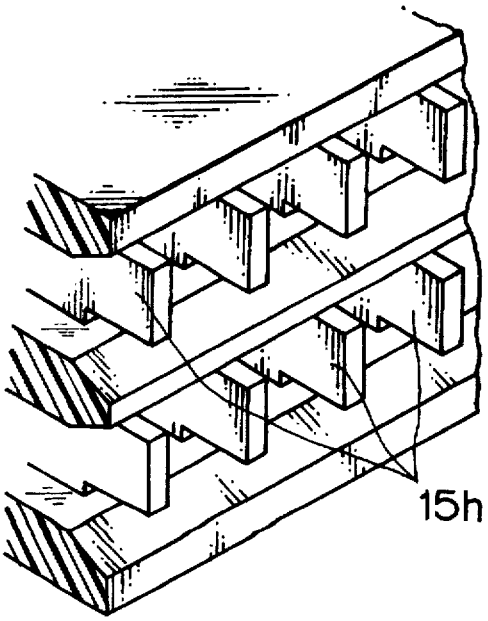
FIG. 2 is a perspective view of side surfaces of terminal accommodating chambers of the connector housing shown in FIG. 1.

On the other hand, as illustrated in FIGS. 1 and 2, the side walls 15*h* of the connector housing 15 according to the present invention have notches at portions adjacent to the upper and lower walls, that is, as illustrated in FIG. 2, the side walls 15*h* are discontinued with the upper and lower walls from terminal insertion openings to portions apart from the openings to some extent. As a result, the side walls 15*h* have horizontal resiliency in FIG. 1.

In the waterproof connector according to the present invention also, like the conventional waterproof connector 1, at first, the waterproof rubber packing 4 is inserted into the waterproof packing accommodating portion 15*b* of the connector housing 15, and the cover 3 is fixed to the connector housing 5 in such a manner as to cover the waterproof rubber packing 4, and at the same time, the waterproof rubber packing 4 is also secured to the connector housing 15 to assemble the waterproof connector. Then, the terminal 2 is inserted into the waterproof connector through the through-holes 3*b* of the cover 3 and the through-holes 4*a* of the waterproof rubber packing 4, and finally the terminal 2 passes through the terminal accommodating chamber 15*d* of the connector housing 15 so as to be locked in the connector housing 15 with the resilient locking arm 15*e*. As a result, behind the terminal 2 accommodated in the terminal accommodating chamber 15*d* is positioned the waterproof rubber packing 4, which prevents the intrusion of the water or the like into the terminal accommodating chamber 15*d* from outside.

Figure 3:
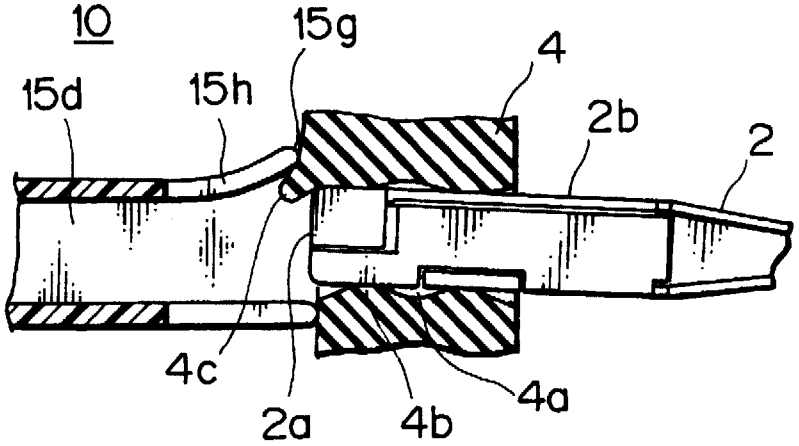
FIG. 3 is a cross-sectional view for explaining the process of inserting a terminal into the waterproof connector according to the present invention.
Figure 4:
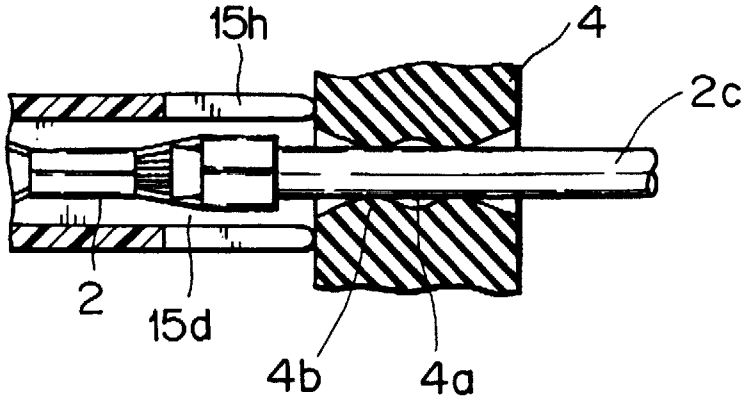
FIG. 4 is a cross-sectional view of a terminal locked in the waterproof connector according to the present invention.
Figure 5:
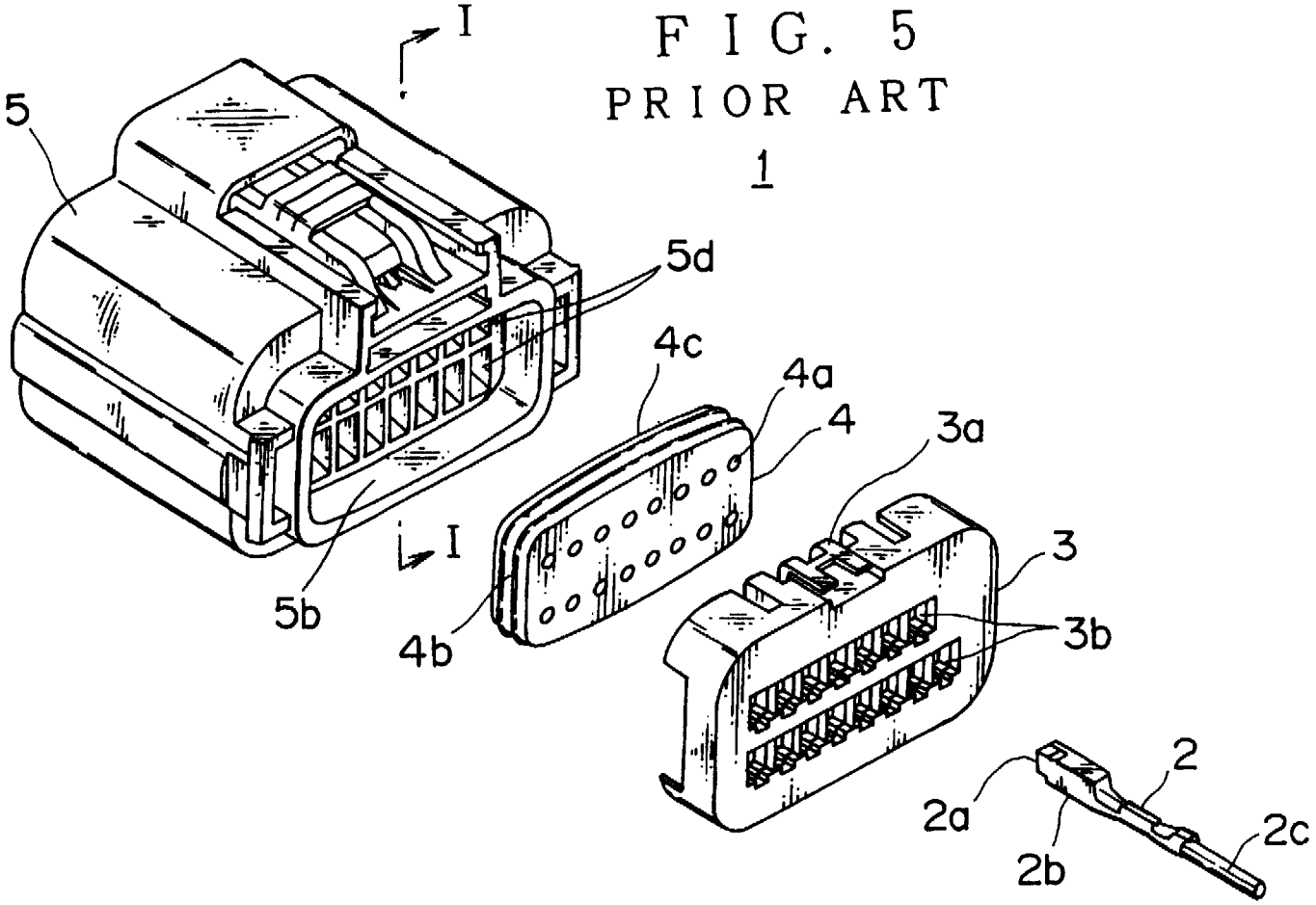
FIG. 5 PRIOR ART
FIG. 5 is an exploded perspective view of a conventional waterproof connector.
Figure 7:
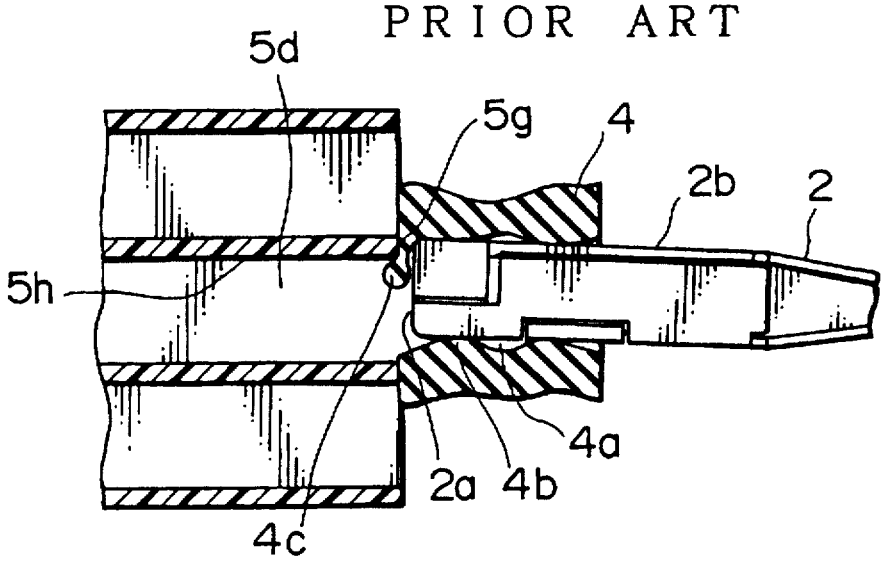
FIG. 7 PRIOR ART
FIG. 7 is a cross-sectional view for explaining the process of inserting a terminal into the conventional waterproof connector.

At that moment, the side walls 15*h* of the connector housing 15 functions as described below. FIG. 3 is a cross-sectional view showing the condition immediately before the tip 2*a* of the terminal 2 is inserted into the terminal accommodating chamber 15*d*, and this figure corresponds to FIG. 7 showing the conventional waterproof connector. As clearly illustrated in FIG. 3, when the tip 2*a* passes through the through-holes 4*a* of the waterproof rubber packing 4, a part of the inner wall 4*b* is leftward moved in this figure, therefore, even if a part 4*c* of the inner wall 4*b* is nipped between the tip 2*a* and the front face 15*g* of the terminal accommodating chamber 15*d*, the side walls 15*h* horizontally and resiliently deform. As a result, after the tip metal 2*b* of the terminal 2 advances in the terminal accommodating chamber 15*d* and is completely locked therein, as illustrated in FIG. 4, the side walls 15*h* return to their original positions, which prevents the inner wall 4*b* of the waterproof rubber packing 4 from being damaged, so that the wire portion 2*c* properly contacts the inner wall 4*b* of the waterproof rubber packing 4 to provide improved waterproof function.

With the waterproof connector according to the present invention, at the insertion of a terminal into the waterproof connector, the inner wall of the waterproof rubber packing is prevented from being damaged, which prevents waterproof function of the waterproof rubber packing from being deteriorated.

What is claimed is:

1. A waterproof connector comprising:

a terminal accommodating chamber having two side walls, wherein each side wall has a length, a width and a thickness and each side wall has a pair of notches therein, through said thickness thereof, and on a terminal insertion side of said terminal accommodating chamber, said notches being at upper and lower corners of said side wall at a location where said side wall intersects upper and lower walls, respectively, of said terminal accommodating chamber so that a portion of each of said side wall on said terminal insertion side of said terminal accommodating chamber has a lessened width from said width of a remainder of said side wall; and a waterproof rubber packing mounted on said terminal insertion side of said terminal accommodating chamber.

2. The waterproof connector as claimed in claim 1, wherein a plurality of terminal accommodating chambers are vertically closely juxtaposed to each other.

3. The waterproof connector as claimed in claim 1, wherein said side wall on said terminal insertion side divides neighboring terminal accommodating chambers.

4. The waterproof connector as claimed in claim 3, wherein a plurality of terminal accommodating chambers are vertically closely juxtaposed to each other.

* * * * *